United States Patent [19]

Belcher

[11] Patent Number: 4,759,083

[45] Date of Patent: Jul. 26, 1988

[54] MEDICAL GARMENT

[76] Inventor: Faye E. Belcher, 13-D Community Cir., Douglasville, Ga. 30134

[21] Appl. No.: 33,832

[22] Filed: Apr. 3, 1987

[51] Int. Cl.[4] ..... A41D 9/00

[52] U.S. Cl. ..... 2/114; 2/DIG. 7

[58] Field of Search ..... 2/DIG. 7, 74, 105, 114, 2/126, 119

[56] References Cited

U.S. PATENT DOCUMENTS

| | | | |
|---|---|---|---|
| 3,154,789 | 11/1964 | Lewis | 2/114 |
| 3,155,984 | 11/1964 | Derrick | 2/114 |
| 3,276,036 | 11/1966 | Cater | 2/114 |
| 3,557,385 | 1/1971 | Hendrickson | 2/114 |
| 3,745,587 | 7/1973 | Bradley | 2/114 |
| 4,612,673 | 9/1986 | Underhill | 2/114 |
| 4,686,714 | 8/1987 | Harley | 2/105 |
| 4,686,715 | 8/1987 | Price | 2/114 |

*Primary Examiner*—Henry S. Jaudon

*Attorney, Agent, or Firm*—Louis T. Isaf

[57] ABSTRACT

An improved medical garment comprises a unique combination of garment panels and parts and releasable closures which function together to define an article of clothing as well as a versatile examination tool.

11 Claims, 3 Drawing Sheets

10
12
14
15
19
20
21
30
31
34,32
35,32
35
36
37
38
50
51
54
55
57
58
60
61
63
64
66
67
A-B
C-D
A
B
C
D
I
J
K
L

MEDICAL GARMENT

FIELD OF THE INVENTION

The present invention relates generally to the field of medical and surgical equipment and more specifically to garments worn by patients for hospital, surgery and examination purposes.

BACKGROUND OF THE INVENTION

There is today no medical garment which appears satisfactory in structure and function to both patients and medical personnel. The industry appears to have ignored the fact that the users of medical garments have unique, serious needs that can be met by practical, well thought out medical garments. Like any other medical equipment, medical garments should be functionally attunded to the needs of the users.

Presently, prior to the present invention, medical garments have been modeled after institutional garments used in hospitals. An example is a smock-type, one piece dress (usually pea green) having two sleeves and a tied (or snapped) opening down the back. Such garments have little practical value to the patient, to the doctor or to the clinical staff. Such garments are especially cumbersome and embarrassing to female patients. Prior art garments are difficult to remove from a patient with an "I.V." (intravenous tubes) in her arm. Removal or changing of clothes requires removal and reinsertion of the I.V. and can be dangerous as well as cumbersome. A female patient who is in for a shoulder examination must expose her entire upper torso for the examination. A patient in for a breast examination must drop her entire gown. It can be seen that other inconveniences and problems beyond those mentioned above are being fostered by prior medical garments.

SUMMARY OF THE INVENTION

Briefly described, the medical garment of the present invention comprises a unique combination of garment panels and parts and releasable closures which function together to define an article of clothing as well as versatile examination tool. The garment of the present invention includes a body part, front and back panels and a shoulder part. These parts and panels are joined by releasable fastening devices by which certain panels and parts are selectively separated for examination access while the garment is still being worn by the patient. In a preferred embodiment, the shoulder part of the present invention comprises front and back yoke portions which support the garment at the shoulders while a front panel is opened for access to the chest region. In other preferred embodiments, the shoulder part includes separable segments by which the garment is supported on the patient by one shoulder segment while the other shoulder segment is opened either alone or in conjunction with the front panel for access to the shoulder, breast, side and pelvic areas. In preferred embodiments, the shoulder part is separable from the front panel and the garment is removable from an I.V. patient without disturbing the I.V.

Therefore, an object of the present invention is to provide a medical garment which functions both as an article of clothing and as an examination tool.

Another object of the present invention is to provide a medical garment which is easily and safely removed from a patient.

Yet another object of the present invention is to provide a versatile surgical and examination garment which allows for selective and separate access to isolated body parts of the user.

Still another object of the present invention is to provide an examination gown which allows for a balance between the need for examination access and the need for personal modesty.

Other objects, features and advantages of the present invention will become apparent upon reading and understanding this specification, in conjunction with the accompanying drawings.

DETAILED DESCRIPTION OF THE PREFERRED EMBODIMENT

Figure 1:
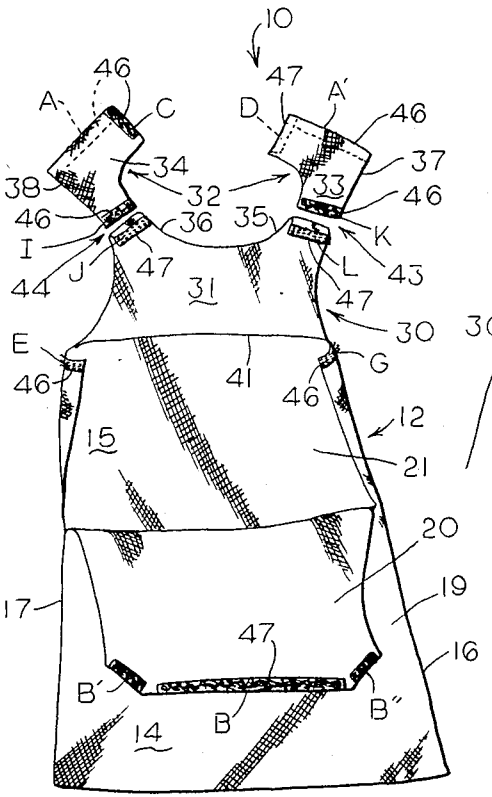
FIG. 1 is a front view of an improved medical garment, in accordance with the present invention, with component parts unfastened.

Refering now in greater detail to the drawings in which like numerals represent like components throughout the several views, FIG. 1 shows a front view of an improved medical garment 10 of the present invention. The medical garment 10 is seen as including a lower dress portion 12 and a shoulder structure 30. The lower dress section 12 is seen as comprising a front dress section 14 and back dress section 15. The front dress section 14 and back dress section 15 are sewn together along their left sides 16 and along their right sides 17. The two dress sections 14, 15 are sewn from the bottom toward the top, along only a portion of their length, as seen in the drawing. The upper portions of the dress section 14, 15 are not sewn together. For ease of description, the lower part of the dress portion where the front and back dress sections 14, 15 are sewn together, shall be generally termed the body structure 19; that part of the front dress section 14 which is not sewn to the back dress section 15 shall be termed the front panel 20; and that part of the back dress section 15 which is not sewn to the front dress section 14 shall be termed the back panel 21. In FIG. 1, the front panel 20 is shown folded down upon the body structure 19 and the back panel 21 is seen.

The shoulder structure 30 is seen as comprising a back yoke 31 and a front yoke 32. The front yoke 32 has two separable halves 33, 34. Protruding from each of the back yoke 31 and front yoke 32 are shoulder segments 35, 36, 37, 38 by which the front yoke 32 is connected to the back yoke 31. The shoulder structure 30 is sewn to the lower dress portion 12 at a seam 41 connecting the back yoke 31 to the back panel 21. In the preferred embodiment of FIG. 1, the shoulder segments 35–38 of the shoulder structure 30 are separable along closure lines 43, 44. In alternate embodiments, the shoulder segments 35–38 are not separable.

The medical garment 10 comprises a plurality of fastening devices for connecting the various components one-to-another. In the preferred embodiment, the fastening devices comprise matching hook-and-loop fastening mechanisms, such as that mechanism sold under the trademark "VELCRO". The hook portions of the hook-and-loop mechanism are designated by the numeral 46; and the loop portion of the mechanisms are designated by the numeral 47. Thus, hook portions 46 are sewn along edges indicated as "A", "A'", "C", "E", "G", "I", "K". Loop-portions are sewn along edges "B", "D", "J", "L".

Figure 3:
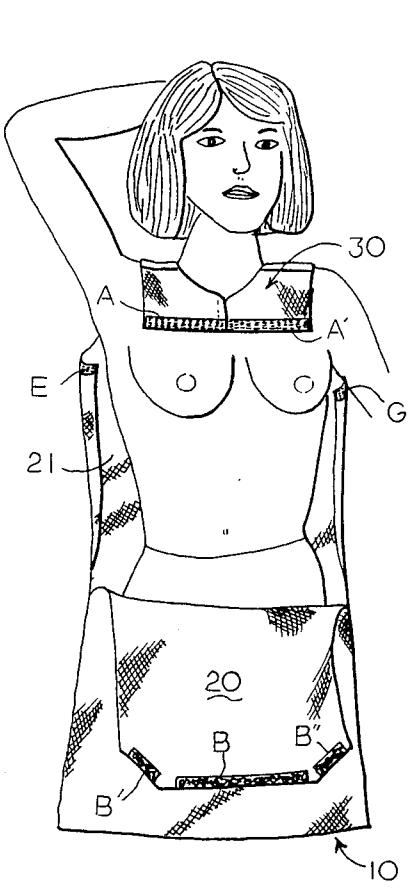
FIGS. 3–7 show various examination modes of the medical garment of FIG. 1, of which there are more variations.
Figure 2:
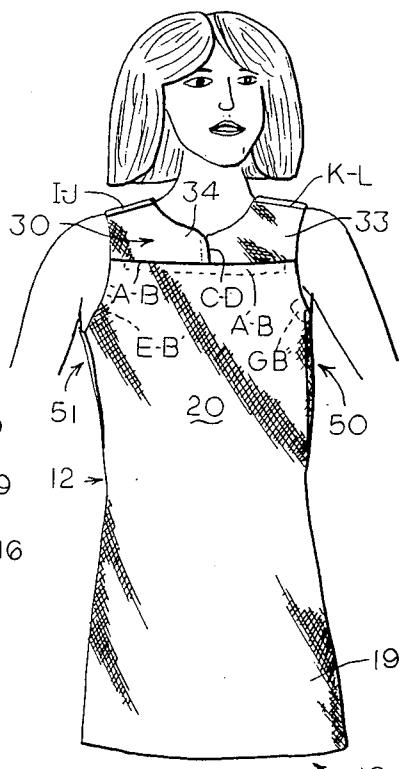
FIG. 2 is a front view of the medical garment of FIG. 1, worn by a patient, with the component parts fastened.

With all of the fastening mechanisms 46, 47 properly connected in matching pairs, the medical garment 10 forms a gown as seen in FIG. 2 ("the gown mode"). Proper connection is as follows: Strip "I" to strip "J"; Strip "K" to strip "L"; Strip "C" to strip "D"; and Strip "B" to strips "A", "A'", "E" and "G". With the garment 10 assembled and being worn in the gown mode, a gap or side opening 50, 51 will be created along the left side and right side, respectively of the front panel 20 and back panel 21. In the preferred embodiment, view through these openings 50, 51 is modestly hindered by locating the fastening mechanism hook strips "E" and "G" on the outside of the back panel 21, as shown in FIG. 1. In this way, as strip "B" is connected to pads "E" and "G", the front and back panel 20, 21 are caused to "curve around" and slightly overlap one another. In an alternate embodiment of the invention, the openings 50, 51 are releasably closed by extending the fastening mechanisms along both edges of the front and back panels 20, 21. Furthermore, in alternate embodiments, strip "B" is segmented, as seen in FIG. 3, such that separate segments "B'", "B'" of strip "B" connect with strips "E" and "G", respectively.

Figure 6:
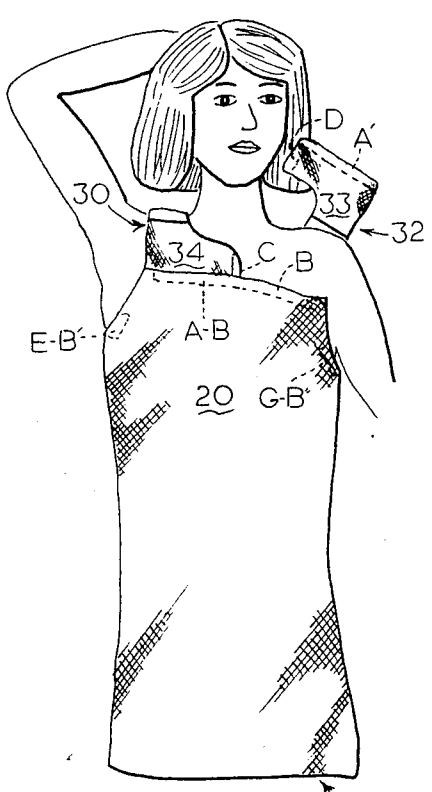
Figure 5:
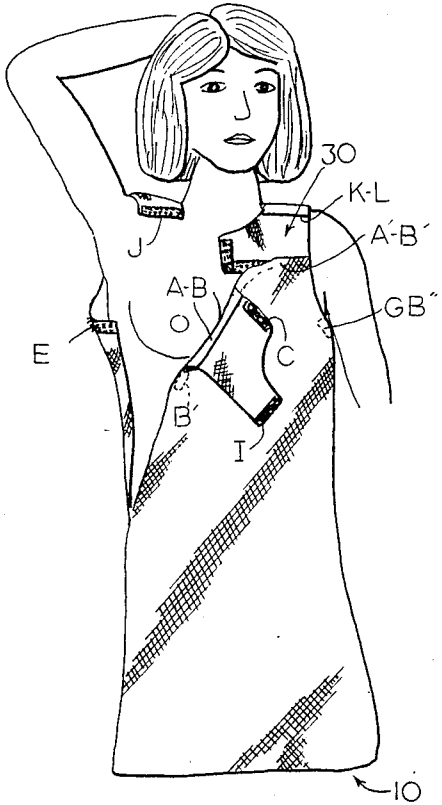
Figure 4:
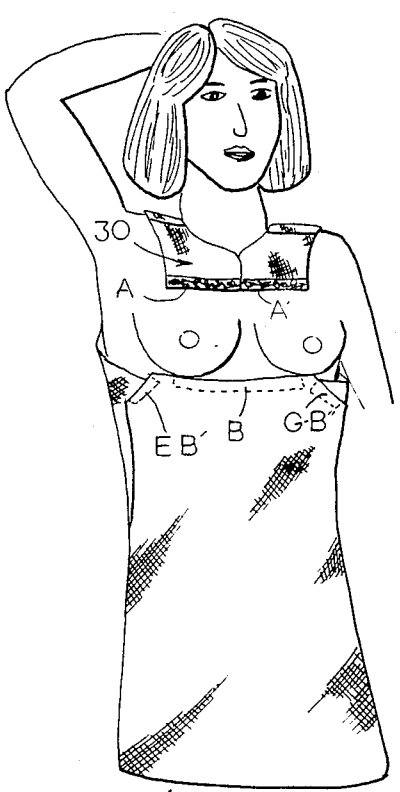
Figures 7, 8, 9, 10:
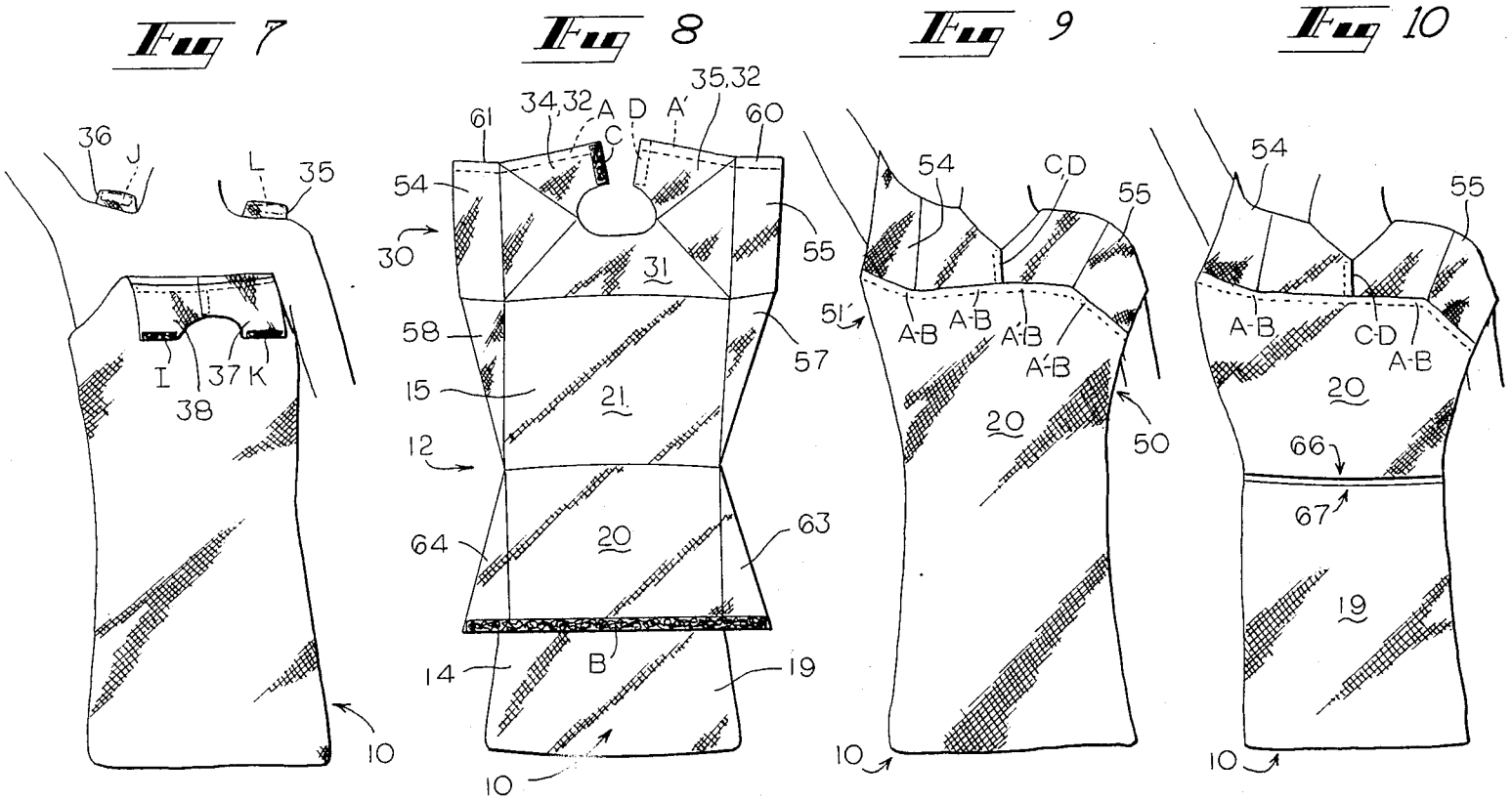
FIG. 8 is a front view of an improved medical garment, in accordance with the present invention, with component parts unfastened, showing an alternate embodiment to that of FIG. 1.
FIG. 9 is a front view of the medical garment of FIG. 7, worn by a patient, with the component parts fastened.
FIG. 10 is a front view of the medical garment of FIG. 7, worn by a patient, with the component parts fastened, showing an alternate embodiment thereof.

Examination Modes. The gown mode of FIG. 2 is the mode by which the medical garment 10 is modestly worn in everyday use or by a patient in a hospital bed. FIGS. 3–7 show various "examination modes" in which this examination tool 10 (garment) functions. It can be seen from FIG. 3 that, with strip "B" unfastened from strips "A", "A'", "E" and "G", a doctor can examine a stomach and/or breast surgery patient without exposing any more of the body than needed. If only the breast area needs to be examined, the garment 10 is only unfastened along edges "A", "A'" and "B". The strip "B" is maintained connected under the arms at strips "E" and "G". This is depicted in FIG. 4. In both modes shown in FIGS. 3 and 4, it is seen that the shoulder structure 30 continues to support the garment 10 from the shoulders of the user. FIG. 5 depicts an examination mode permitting isolated examination of one side of the patient's torso, for example, right shoulder, right chest and breast area, and right side to the pelvic area. In the examination mode of FIG. 5, the garment 10 has been unfastened at strips "I" and "J" and also at strip "E" and strip "B" (the right underarm fastener). FIG. 6 shows an examination mode allowing isolated examination of the left shoulder area. The examination mode of FIG. 6 is created by unfastening the left half 33 of the front yoke 32 from the front panel 20; that is releasing strip "A'" (left half only) from fastening strip "B" and strip "D" from strip "C". Strip "B" remains fastened at strips "E", "G" and "A" (right side). It is noted that during the examination mode of FIGS. 5 and 6, the medical garment 10 continues to be supported on the body of the patient from one shoulder. FIG. 7 depicts a removal mode by which the medical garment 10 can be removed from the patient. This particular mode of FIG. 7 shows release of the shoulder segments 35, 37 and 36, 38 from both sides (at strips I–J and K–L) so as to slide the garment 10 on and off the patient with relative ease. In the removal mode of FIG. 7, an intravenous patient is dressed without need for disturbing intravenous tubes.

FIG. 8 shows an alternate embodiment of the medical garment 10. This garment includes sleeves, having a right sleeve member 54 and a left sleeve member 55. The back panel 21 is further formed with triangler shaped left sleeve extension 57 and right sleeve extension 58. The sleeve members 54, 55 are sewn to the sleeve extension 57, 58 of the back panel at seam 41'. The hook strips "A", "A'" extend from the front yoke 32 along the front edges 60, 61 respectively, of the sleeve members 54, 55. The front panel 20 is also formed with a triangular left sleeve extension 63 and a triangular right sleeve extension 64. The garment 10 embodiment of FIG. 8 includes fastening mechanisms having hook strips "A", "A'" and "C" and loop strips "B" and "D". Thus, when worn by the patient the garment 10 provides releasable closures along edges A–B and C–D. With the medical garment 10 fully connected and worn by the patient, as seen in FIG. 9, a left side opening 50' and right side opening 51'' exist between the front panel 20 and the back panel 21. The sleeve members 54, 55 and sleeve extensions 57, 58, 63, 64 cooperate to shield these openings for modesty's sake. Various examination modes are possible with the embodiment of FIGS. 8 and 9 as are hinted at by reviewing FIGS. 3–7, in light of the structure of this alternate embodiment.

FIG. 10 shows yet another alternate embodiment of the medical garment 10. The embodiment of FIG. 10 is shown as being similar in structure to that of FIGS. 8 and 9. An additional, releasable enclosure is provided in this embodiment at the junction between the bottom edge 66 of the front panel 20 and the top edge 67 of the body structure 19. This closure 66–67 is created by providing the two opposing edges 66, 67 with a fastening mechanisms similar to those described above; that is, preferably, hook-and-loop strips. Thus, in addition to the other examination modes described with respect to FIGS. 1–9, the embodiment FIG. 10 provides for isolated examination access to the abdominal area of the patient by simple release of the closure 66–67. It is understood that this same alternate closure 66–67, although shown as an alternate to the embodiment of FIGS. 8–9, finds similar applications as an alternate to the embodiment of FIGS. 1–7.

Whereas the embodiments shown in the accompanying drawings, represent the most preferred, versatile embodiment of the present invention, it is understood that others embodiments are within the scope of the present invention which include combinations of one or more of the releasable closures and related fastening mechanisms expressed herein. Furthermore, whereas the fastening mechanisms have been described with respect to a particular, preferred embodiment, other, practical fastenings mechanisms may be employed to replace those described, and to perform a similar function.

Whereas the present invention has been described in detail with particular reference to preferred embodiments thereof, it will be understood that variations and modifications can be effected within the spirit and scope of the invention, as described before and as defined in the appended claims.

I claim:

1. A surgical and examination garment, comprising:

a body structure for encircling the body of a human user, said body structure including a back portion and a front portion, said body structure defining a left side, a right side, a top end and a bottom end;

a back panel including upper edge, lower edge, right edge and left edge, said edges defining an upper-left corner and an upper-right corner, and said back panel being attached at said lower edge to said top end of said back portion of said body structure;

a front panel including upper edge, lower edge, right edge and left edge, said edges defining an upper-left corner and an upper-right corner, and said front panel being attached at said lower edge to said top end of said front portion of said body structure;

a shoulder structure, said shoulder structure including a back yoke for resting on the back shoulder area of the human user, a front yoke for resting on the upper chest area of the human user, a left shoulder segment connecting said back yoke and said front yoke, and a right shoulder segment connecting said back yoke and said front yoke, said left shoulder segment and said right shoulder segment defining a neck opening between them, said shoulder structure being attached at said back yoke to said upper edge of said back panel;

left side fastening means for releasably fastening said upper-left corner of said front panel to said upper-left corner of said back panel;

right side fastening means for releasably fastening said upper-right corner of said front panel to said upper-right corner of said back panel;

chest area fastening means for releasably fastening said upper edge of said front panel to said front yoke of said shoulder structure.

2. The garment of claim 1, further comprising:

a left side opening defined between said left edge of said front panel and said left edge of said right panel and extending from said left side fastening means to said top edge of said body structure; and a right side opening defined between said right edge of said front panel and said right edge of said back panel and extending from said right side fastening means to said top edge of said body structure.

3. The garment of claim 2, further comprising left overlapping means for overlapping said left side opening and right overlap means for overlapping said right side opening.

4. The garment of claim 1, wherein said left side fastening means releasably fastens said left side of said front panel to said left side of said back panel, and said right side fastening means releasably fastens said right side of said front panel to said right side of said back panel.

5. The garment of claim 1, wherein said front yoke of said shoulder structure includes a left side to which said left shoulder segment is connected and a right side to which said right shoulder segment is connected, and wherein said garment further comprises a yoke front fastening means for releasably fastening said left side of said front yoke to said right side of said front yoke.

6. The garment of claim 1, wherein said left shoulder segment and said right shoulder segment each comprises a front shoulder element releasably connected to a back shoulder element, and wherein said garment further comprises left shoulder fastening means for releasably fastening said front shoulder element of said left shoulder segment to said back shoulder element of said left shoulder segment, and right shoulder fastening means for releasably fastening said front shoulder element of said right shoulder segment to said back shoulder element of said right shoulder segment.

7. The garment of claim 1, wherein said front panel is releasably attached to said top end of said front portion of said body structure, and wherein said garment further comprises stomach area fastening means for releasably fastening said lower edge of said front panel to said top end of said front portion of said body structure.

8. A surgical and examination garment, comprising:

a body structure for encircling the body of a human user, said body structure including a back portion and a front portion, said body structure defining a left side, a right side, a top end and a bottom end;

a back panel including upper edge, lower edge, right edge and left edge, said edges defining an upper-left corner and an upper-right corner, and said back panel being attached at said lower edge to said top end of said back portion of said body structure;

a front panel including upper edge, lower edge, right edge and left edge, said edges defining an upper-left corner and an upper-right corner, and said front panel being releasably attached at said lower edge to said top end of said front portion of said body structure;

a shoulder structure, said shoulder structure including a back yoke for resting on the back shoulder area of the human user, a front yoke for resting on the upper chest area of the human user, a left shoulder segment connecting said back yoke and said front yoke, and a right shoulder segment connecting said back yoke and said front yoke, said left shoulder segment and said right shoulder segment defining a neck opening between them, said front yoke of said shoulder structure including a left side to which said left shoulder segment is connected and a right side to which said right shoulder segment is connected, said shoulder structure being attached at said back yoke to said upper edge of said back panel, said left shoulder segment and said right shoulder segment each comprising a front shoulder element releasably connected to a back shoulder element;

left side fastening means for releasably fastening said upper-left corner of said front panel to said upper-left corner of said back panel;

right side fastening means for releasably fastening said upper-right corner of said front panel to said upper-right corner of said back panel;

chest area fastening means for releasably fastening said upper edge of said front panel to said front yoke of said shoulder structure.

yoke front fastening means for releasably fastening said left side of said front yoke to said right side of said front yoke;

left shoulder fastening means for releasably fastening said front shoulder element of said left shoulder segment to said back shoulder element of said left shoulder segment;

right shoulder fastening means for releasably fastening said front shoulder element of said right shoulder segment to said back shoulder element of said right shoulder segment; and stomach area fastening means for releasably fastening said lower edge of said front panel to said top end of said front portion of said body structure.

9. A surgical and examination garment, comprising:

a body structure for encircling the body of a human user, said body structure including a back portion and a front portion, said body structure defining a left side, a right side, a top end and a bottom end;

a back panel including upper edge, lower edge, right edge and left edge, said edges defining an upper-left corner and an upper-right corner, and said back panel being attached at said lower edge to said top end of said back portion of said body structure;

a front panel including upper edge, lower edge, right edge and left edge, said edges defining an upper-left corner and an upper-right corner, and said front panel being attached at said lower edge to said top end of said front portion of said body structure;

a shoulder structure, said shoulder structure including a back yoke for resting on the back shoulder area of the human user, a front yoke for resting on the upper chest area of the human user, a left shoulder segment connecting said back yoke and said front yoke, and a right shoulder segment connecting said back yoke and said front yoke, said left shoulder segment and said right shoulder segment defining a neck opening between them, said shoulder structure being attached at said back yoke to said upper edge of said back panel;

said shoulder structure including a left sleeve member extending from said left shoulder segment to overlie a portion of the left arm of a human user, and a right sleeve member extending from said right shoulder segment to overlie a portion of the right arm of a human user, each said sleeve member comprising a back edge connected to said back panel and a front edge;

said front panel and back panel extending the full width of said shoulder structure, including both said right and left sleeve members; and chest area fastening means for releasably fastening said upper edge of said front panel to said front yoke of said shoulder structure and to said front edge of said left sleeve member and to said front edge of said right sleeve member.

10. The garment of claim 9, wherein said front yoke of said shoulder structure includes a left side to which said left shoulder segment is connected and a right side to which said right shoulder segment is connected, and wherein said garment further comprises a yoke front fastening means for releasably fastening said left side of said front yoke to said right side of said front yoke.

11. The garment of claim 9, wherein said front panel is releasably attached to said top end of said front portion of said body structure, and wherein said garment further comprises stomach area fastening means for releasably fastening said lower edge of said front panel to said top end of said front portion of said body structure.

* * * * *